US005890870A

United States Patent [19]

Berger et al.

[11] Patent Number: 5,890,870

[45] Date of Patent: Apr. 6, 1999

[54] ELECTRONIC RIDE CONTROL SYSTEM FOR OFF-ROAD VEHICLES

[75] Inventors: Alan D. Berger, Winfield; Ketan B. Patel, Carol Stream, both of Ill.

[73] Assignee: Case Corporation, Racine, Wis.

[21] Appl. No.: 803,414

[22] Filed: Feb. 20, 1997

Related U.S. Application Data

[63] Continuation-in-part of Ser. No. 718,925, Sep. 25, 1996.

[51] Int. Cl.[6] ..... B66F 9/00

[52] U.S. Cl. ..... 414/699; 60/469; 91/433; 414/719

[58] Field of Search ..... 414/685, 697, 414/699, 719; 60/469; 91/433

[56] References Cited

U.S. PATENT DOCUMENTS

| | | | |
|---|---|---|---|
| 4,904,150 | 2/1990 | Svensson et al. . | |
| 4,953,723 | 9/1990 | Saotome et al. | 212/159 |
| 4,995,517 | 2/1991 | Saotome | 212/146 |
| 5,034,892 | 7/1991 | Saotome | 364/424.07 |
| 5,147,172 | 9/1992 | Hosseini . | |
| 5,195,864 | 3/1993 | Drake et al. . | |
| 5,520,499 | 5/1996 | Ufneil et al. . | |
| 5,622,226 | 4/1997 | Hausman et al. | 172/4.5 |

FOREIGN PATENT DOCUMENTS

| | | |
|---|---|---|
| 0 378 129 A1 | 7/1990 | European Pat. Off. . |
| 0 747 797 A1 | 12/1996 | European Pat. Off. . |
| 5-60104 | 3/1993 | Japan . |
| 5-163746 | 6/1993 | Japan . |
| 7-32848 | 2/1995 | Japan . |
| 8-13546 | 1/1996 | Japan . |
| 8-302753 | 11/1996 | Japan . |

*Primary Examiner*—Donald W. Underwood
*Attorney, Agent, or Firm*—Foley & Lardner

[57] ABSTRACT

A control system for improving the roadability of a wheeled excavator is disclosed herein. The excavator is the type including an implement such as a bucket or backhoe which is moved relative to the excavator by hydraulic actuators. Hydraulic fluid is applied to the actuators via electronic valves which are controlled by an electronic controller. Based upon acceleration of the vehicle, the electronic controller controls the electronic valve to maintain fluid pressure in the actuator or the acceleration substantially constant. Additionally, the controller can be configured to maintain the average position of the implement generally constant. By controlling the pressure in the hydraulic actuator, the undesirable bouncing or pitching of the excavator can be reduced when the vehicle is traveling at road or loading speeds.

21 Claims, 4 Drawing Sheets

ELECTRONIC RIDE CONTROL SYSTEM FOR OFF-ROAD VEHICLES

This application is a continuation-in-part of application Ser. No. 08/718,925, filed Sep. 25, 1996.

FIELD OF THE INVENTION

The present invention relates to controlling the ride of a work vehicle such as a wheeled loader or tractor including a backhoe, bucket or implement. In particular, the present invention relates to controlling the action of the backhoe, bucket or other implement to improve the ride of the associated off-road or construction vehicle.

BACKGROUND OF THE INVENTION

Various types of off-road or construction vehicles are used to perform excavation functions such as leveling, digging, material handling, trenching, plowing, etc. These operations are typically accomplished with the use of a hydraulically operated bucket, backhoe or other implement. These implements include a plurality of linkages translationally supported and rotationally supported, and are moved relative to the supports by hydraulic cylinders or motors. As a result of the type of work excavators are used to perform (i.e. job site excavation) these excavators are often required to travel on roads between job sites. Accordingly, it is important that the vehicle travel at reasonably high speeds. However, due to the suspension, or lack thereof, and implements supported on the vehicle, vehicle bouncing, pitching or oscillation occurs at speeds satisfactory for road travel.

In an attempt to improve roadability, various systems have been developed for interacting with the implements and their associated linkages and hydraulics to control bouncing and oscillation of excavation vehicles while operating at road speeds. One such system includes circuitry for lifting and tilting an implement combined with a shock absorbing mechanism. This system permits relative movement between the implement and the vehicle to reduce pitching of the vehicle during road travel. To inhibit inadvertent vertical displacement of the implement, the shock absorbing mechanism is responsive to lifting action of the implement. The shock absorbing mechanism is responsive to hydraulic conditions indicative of imminent tilting movement of the implement thereby eliminating inadvertent vertical displacement of the implement.

Other systems for improving the performance of excavators have included accumulators which are connected and disconnected to the hydraulic system depending upon the speed of the vehicle. More specifically, the accumulators are connected to the hydraulic system when the excavator is at speeds indicative of a driving speed and disconnected at speeds indicative of a loading or dumping speed.

These systems may have provided improvements in roadability, but it would be desirable to provide an improved system for using the implements of excavation vehicles to improve roadability. Accordingly, the present invention provides a control system which controls the pressure in the lift cylinders of the implement(s) associated with an excavation vehicle based upon the acceleration of the vehicle.

SUMMARY OF THE INVENTION

An embodiment of the present invention provides a control system for an excavator of the type including an implement moveable relative to the excavator. The system includes a hydraulic fluid source, a hydraulic actuator, and an electronic valve coupled to the source and the actuator to control the flow of hydraulic fluid applied to the actuator by the source. A pressure transducer is provided to generate a pressure signal related to the pressure in the actuator. The system also includes an electronic controller coupled to the electronic valve and the pressure transducer. The controller determines the acceleration of the excavator based upon the pressure signal, and applies control signals to the electronic valve to cause the electronic valve to control the flow of hydraulic fluid applied to the actuator to maintain the pressure signal substantially constant.

An alternative embodiment of the control system includes an accelerometer instead of the pressure transducer. The accelerometer is coupled to the excavator to generate an acceleration signal representative of the acceleration of the excavator. The controller determines the acceleration of the excavator based upon the acceleration signal, and applies control signals to the electronic valve to cause the electronic valve to control the flow of hydraulic fluid applied to the actuator to maintain the acceleration signal substantially constant at a value of zero.

The present invention also relates to an excavator including a wheeled vehicle, an implement movably supported by the vehicle, a hydraulic fluid source supported by the vehicle, and a hydraulic actuator coupled between the implement and vehicle to move the implement relative to the vehicle. An electronic valve is coupled to the source and the actuator to control the flow of hydraulic fluid applied to the actuator by the source. The excavator also includes means for generating an acceleration signal representative of the acceleration of the vehicle, and an electronic controller coupled to the electronic valve and the accelerometer. The controller determines the acceleration of the excavator based upon the acceleration signal, and applies control signals to the electronic valve to cause the electronic valve to control the flow of hydraulic fluid applied to the actuator to maintain the pressure signal substantially constant based upon the acceleration signal.

DETAILED DESCRIPTION OF THE PREFERRED EMBODIMENTS

Figure 1:
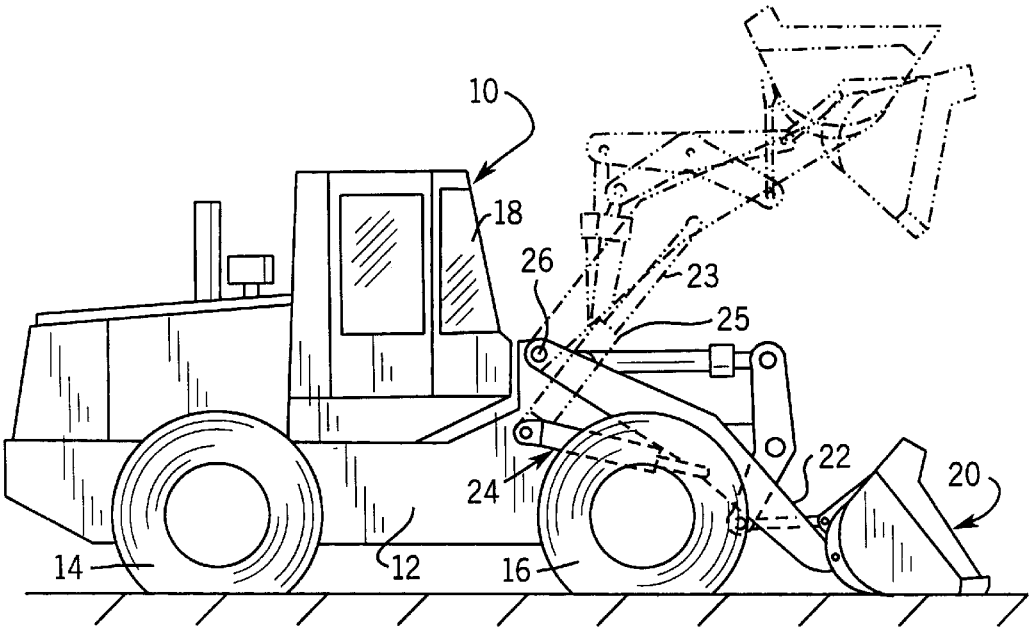
FIG. 1 is a schematic side elevation view of a wheel loader equipped with a bucket or other suitable implement shown in various elevational and tilted positions.

Referring now to FIG. 1, a wheel loader 10, which is illustrative of the type of off-road construction vehicle in which the present control system can be employed, is shown. Wheel loader 10 includes a frame 12; air filled tires 14 and 16; an operator cab 18; a payload bucket 20 or other suitable implement; a pair of lift arms 22; a pair of hydraulic actuators 24; hydraulic actuator columns 23; and hydraulic actuator cylinders 25.

Frame 12 of wheel loader 10 rides atop tires 14 and 16. Frame 12 carries the operator cab 18 atop the frame. A pair of lift arms 22 are connected to frame 12 via a pair of arm pivots 26. The lift arms are also connected to the frame by hydraulic actuators 24 which are made up of actuator columns 23 which translate relative to actuator cylinders 25. Payload bucket 20 is pivotally connected to the end of lift arms 22.

Wheel loader 10 includes a hydraulic system 50 coupled to actuators 24 to raise, lower, or hold bucket 20 relative to frame 12 to carry out construction tasks such as moving and unloading the contents thereof. More specifically, hydraulic actuators 24 control movement of the lift arms 22 for moving bucket 20 relative to frame 12. (Bucket 20 may be rotated by a hydraulic actuator which could be controlled by system 50.) Actuator columns 23 extend relative to actuator cylinders 25 forcing lift arms 22 to pivot about arm pivots 26 causing bucket 20 to be raised or lowered, as shown by phantom lines in FIG. 1.

Figure 2:
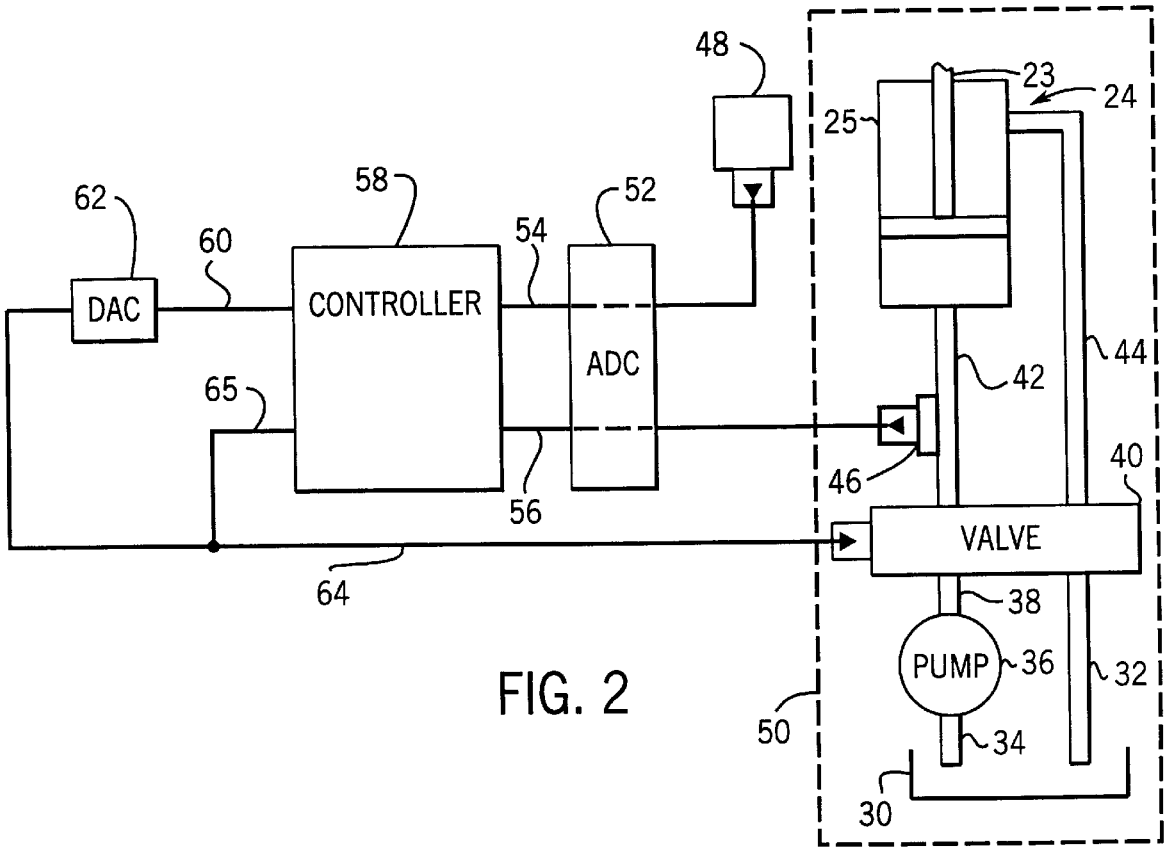
FIG. 2 is a diagrammatic view of a hydraulic actuator system used with the wheel loader illustrated in FIG. 1 and including an electronic controller according to the present invention.

Referring to FIG. 2, the hydraulic system 50 also includes a hydraulic fluid source 30; a hydraulic return line 32; a hydraulic supply conduit 34; a hydraulic pump 36; hydraulic lines 38, 42, and 44; an electronic valve 40; and a pressure transducer 46. Hydraulic system 50 also includes a position sensor 48; an analog-to-digital converter (ADC) 52; a position signal data bus 54; a pressure signal data bus 56; an electronic controller 58; a control signal data bus 60; a digital to analog converter 62; and an analog control signal conductor 64. By way of example, valve 40 may be a Danfoss electrohydraulic valve with spool position feedback.

Hydraulic fluid source 30 is connected to pump 36 via hydraulic supply conduit 34, pump 36 is connected to electronic valve 40 via line 38, electronic valve 40 is connected to hydraulic actuator 24 via lines 42 and 44, and pressure sensor 46 is also in fluid communication with line 42. Hydraulic actuator 24 is also connected to electronic valve 40 via line 44. Electronic valve 40 is further connected to hydraulic source 30 via hydraulic return line 32 thereby completing the hydraulic circuit of hydraulic system 50. Pressure transducer 46 and position sensor 48 are connected to ADC 52. Electronic controller 58 is connected to ADC 52 via position signal data bus 54 and pressure signal data bus 56, connected to DAC 62 via control signal data bus 60, which is connected to valve 40 via analog control signal bus 64.

Electronic controller 58 operates to keep the pressure in hydraulic actuators 24 relatively constant thereby dampening vertical motions of the vehicle. In operation, pressure transducer 46, which is in fluid communication with the hydraulic fluid, measures the pressure in hydraulic line 42 which is substantially the same as that in hydraulic actuator 24. A signal from pressure transducer 46 is communicated to ADC 52 where the analog sensor signal is converted to a digital signal. Position sensor 48 measures the angular position of the lift arms 22. The analog position sensor signal is also sent to the ADC where it is converted to a digital signal. The sampled position signal and the sampled pressure signal are communicated to electronic controller 58 over data buses 54 and 56 respectively. Using the sampled sensor information electronic controller 58 calculates a digital control signal. The digital control signal is passed over data bus 60 to DAC 62 where the digital signal is converted to an analog control signal that is transmitted over connection 64 to electronic valve 40.

By way of example, controller 58 could be a digital processing circuit such as an Intel 87C196CA coupled to a 12 bit ADC. Furthermore, DAC 62 typically would include appropriate amplification and isolation circuits to protect the associated DAC and control valve 40. Alternatively, DAC 62 could be eliminated by programming controller 58 to generate a pulse-width-modulated (PWM) signal. Valve 40 would in turn be a PWM valve controllable with a PWM signal.

Electronic valve 40 controls the flow of hydraulic fluid into and out of hydraulic actuator 24 thereby causing actuator column 23 to move in or out of actuator cylinder 25. Hydraulic fluid is supplied to electronic valve 40. The fluid originates from hydraulic fluid source 30, through supply conduit 34, to pump 36 which forces the hydraulic fluid through line 38 and into electronic valve 40. Electronic valve 40 controls the ingress and egress of hydraulic fluid to hydraulic actuator 24. Electronic valve 40 controls both the path of flow for the hydraulic fluid and the volumetric flow of hydraulic fluid. Electronic valve 40 directs hydraulic fluid either into line 42 and out of line 44 or into line 44 and out of line 42 depending on the intended direction of travel of actuator 24. The analog control signal received from bus 64 commands electronic valve 40 to control both the direction of hydraulic fluid flow and the volumetric flow of the fluid. By way of example, both the fluid direction signal and the flow volume signal can be generated by DAC 62. However, the flow direction signal may be generated at a digital I/O 65 of controller 58, and if a PWM valve is used, the PWM signal applied to the valve can also be generated at a digital I/O. Excess hydraulic fluid is directed by electronic valve 40 through return line 32 and back to hydraulic fluid source 30.

Figure 3:
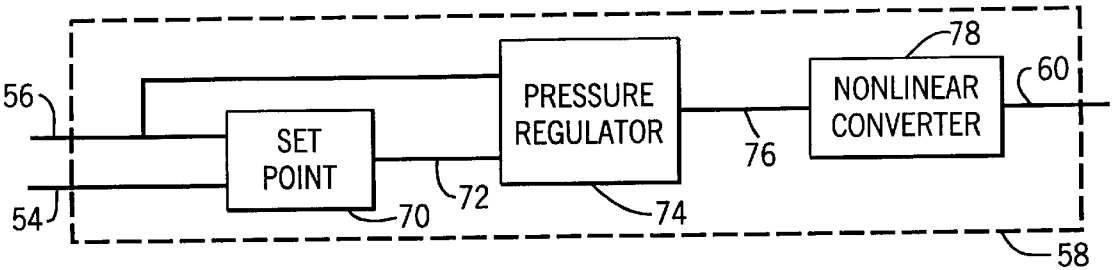
FIG. 3 is a schematic block diagram of the ride control system forming part of the present invention.

Referring to FIG. 3, electronic controller 58 includes a setpoint calculator 70; a pressure regulator 74; a nonlinear converter 78; a pressure set point signal bus 72; and an ideal pressure control signal bus 76.

The input side of electronic controller 58 is connected to data buses 54 and 56. Data buses 54 and 56 are connected to set point calculator 70. Pressure regulator 74 is connected to data bus 56 and set point calculator 70 via pressure set point signal connection 72. Ideal pressure control signal connection 76 connects pressure regulator 74 to nonlinear converter 78. Nonlinear converter 78 connects the output side of electronic controller 58 to data bus 60.

Setpoint calculator 70 calculates the pressure setpoint used by electronic controller 58 to maintain the hydraulic fluid pressure in actuator 24 relatively constant. To calculate the proper pressure setpoint, information from both pressure transducer 46 and position sensor 48 is communicated to pressure setpoint calculator over data bus 56 and 54 respectively. The output of setpoint calculator 70 is a pressure setpoint signal passed over bus 72 to pressure regulator 74. Pressure regulator 74 uses information from pressure set point calculator 70 and from pressure transducer 46 passed over data bus 56 to calculate an ideal pressure control signal. The ideal pressure control signal is passed over bus 76 to nonlinear converter 78. Nonlinear converter 78 outputs a sampled control signal over data bus 60.

Figure 4:
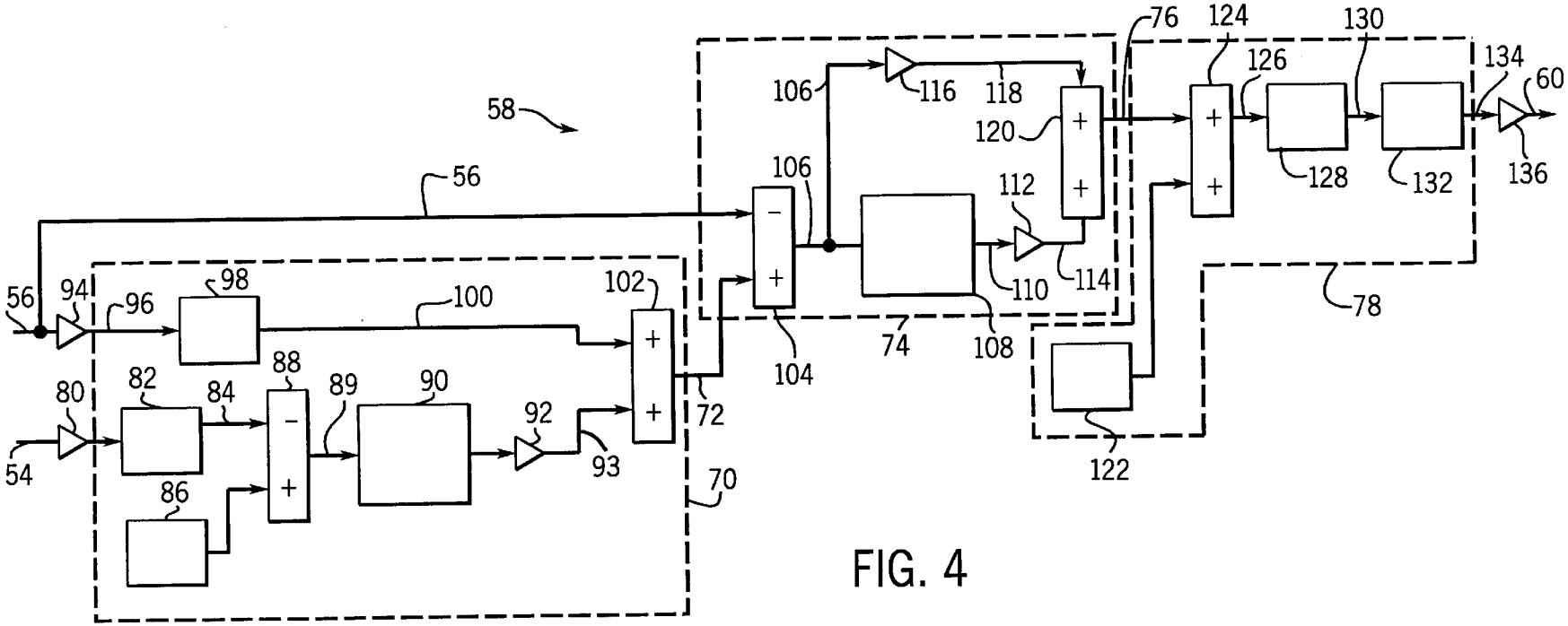
FIG. 4 is a schematic block diagram of the electronic controller forming part of the present invention.

Referring to FIG. 4, setpoint calculator 70 includes amplifiers 80, 92, and 94; a voltage to displacement converter 82; a position setpoint memory 86; a differencing junction 88; a deadzone nonlinearity circuit 90; a single pole low-pass filter 98; a summing junction 102; a position error signal bus 89; and signal buses 84, 93, 96, and 100. Pressure regulator 74 includes a differencing junction 104; a state estimation circuit 108; a derivative gain circuit 112; a proportional gain circuit 116; a summing junction 120; an error signal bus 106; a time rate of change of pressure error signal connection 110; and signal connections 114 and 118. Nonlinear converter 78 includes a pressure signal bias memory 122; a summing junction 124; a coulombic friction circuit 128; a saturation circuit 132; an amplifier 136; and signal buses 126, 130, and 134.

Data bus 54 and 56 are connected to the input side of setpoint calculator 70. Data bus 54 is connected to gain 80. The output of amplifier 80 is connected to converter 82. The output of converter 82 and memory 86 are connected to differencing junction 88.

Setpoint calculator 70 receives a signal from position signal data bus 54. This signal is amplified by amplifier 80 to generate a signal applied to converter 82 which seals the signal to correspond (e.g. proportional to) to displacement of lift arms 22. The sealed signal is compared with position setpoint selected with memory 86 at differencing junction 88 to generate an error signal. The error signal is communicated to deadzone nonlinearity 90 which provides a zero output when the position of the lift arms 22 are within a predetermined range of the setpoint (e.g. two degrees). Thus, deadzone nonlinearity 90 ensures that the position control does not interfere with small motions created by the pressure control. The signal output by deadzone nonlinearity circuit 90 is amplified by amplifier 92, set at 0.02 in the present embodiment. Amplifier 92 modifies the signal to correspond to actuator pressure when applied to summing junction 102 as discussed in further detail below.

Setpoint calculator 70 also receives a sampled pressure signal from data bus 56. The sampled pressure signal is multiplied by amplifier 94. This signal is communicated via bus 96 to single pole low-pass filter 98 which has a cut-off frequency at 0.1 Hz in the present embodiment. The signals from low-pass filter 98 and amplifier 92 are passed via buses 100 and 93, respectively, to summing junction 102 where they are added to produce a pressure setpoint signal and are applied to pressure regulator 74.

Pressure signal data bus 54 and pressure setpoint signal bus 72 are connected to the input side of pressure regulator 74. Buses 54 and 72 are connected to summing junction 104. The output connection 106 of summing junction 104 is split, and coupled with state estimator 108 and proportional gain-circuit 116. Bus 110 of state estimation circuit 108 is connected to derivative gain amplifier 112. Bus 114 of amplifier 112 and bus 118 of proportional gain amplifier 116 are connected to summing junction 120 which is connected to ideal pressure control signal bus 76.

Pressure regulator 74 receives the sampled pressure signal over data bus 56 and the calculated pressure setpoint signal over bus 72. The two signals are compared using differencing junction 104 which produces a pressure error signal that is applied to proportional gain amplifier 116 and state estimation circuit 108. State estimator 108 calculates an estimate of the time rate of change of the pressure error signal. This signal is applied to derivative gain amplifier 112 (e.g. amplification of 5 to 1), which multiplies the signal and applies it to summing junction 120. Proportional gain amplifier 116 (e.g. amplification of 40 to 1) multiplies the signal and applies the multiplied signal to summing junction 120. The signals communicated over buses 118 and 114 to junction 120 are both added by summing junction 120 to yield the ideal pressure control signal which is applied to nonlinear converter 78 via bus 76.

Pressure control signal bus 76 is connected to the input side of nonlinear conversion circuit 78. Bus 76 and offset memory 122 are both connected to summing junction 124. Output bus 126 of summing junction 124 is connected to coulombic friction element 128, and coulombic friction element 128 is connected to saturation element 132. Output connection 134 couples saturation element 132 to amplifier 136 which is connected to control signal data bus 60.

The purpose of nonlinear conversion circuit 78 is to transform the ideal pressure control signal to a valve command signal which takes into account nonlinear effects of valve 40 including frictional losses and saturation in which the valve has some maximum hydraulic fluid flow rate. Circuit 78 adds the ideal pressure control signal to the value set by circuit 122 at summing junction 124. The purpose of the bias is to make a no-flow command correspond to the center position of the valve. Summing junction 124 communicates a signal over bus 126 to coulombic friction circuit 128. Coulombic friction circuit 128 compensates for the deadband of electronic valve 40, and modifies the signal based upon the deadband. Circuit 128 adds a positive offset to positive signals and adds a negative offset to negative signals. Coulombic friction circuit 128 communicates a signal over connection 130 to saturation element 132. Saturation element 132 models the maximum and minimum flow limitations of electronic valve 40 and clips the signal if it corresponds to flow values outside of the maximum or minimum flow values of the valve. Saturation element 134 communicates a signal over connection 136 to amplifier 136 which generates the sampled valve command which is communicated over control signal data bus 60. In the preferred embodiment circuits 70, 74 and 78 are implemented with a programmed digital processor. Thus, prior to amplification by amplifier 136, the flow control signal would be applied to DAC 62.

Low-pass filter 98 is not limited to a filter with cut-off frequency of 0.1 Hz but only requires a filter with cut-off frequency that is substantially below the natural resonant frequency of the vehicle/tire system. The low-pass filter 98 is also not limited to being a single pole filter, but may be a filter having multiple poles. The gain values and offset constants are not limited to the values described above but may be set to any values that will achieve the goal of keeping the hydraulic actuator pressure substantially constant while keeping the implement in a generally fixed position. The ride control system is further not limited to having both a position sensor 48 as well as a pressure transducer 46, but may function without the position sensor. The position sensor aids in limiting the implement to relatively small displacements. If the ride control system is to include position sensor 48, it may be but is not limited to be a rotary potentiometer, which measures angular position of the lift arms, or a linear voltage displacement transducer (LVDT), which measures the extension or distension of actuator shaft 23.

Figure 5:
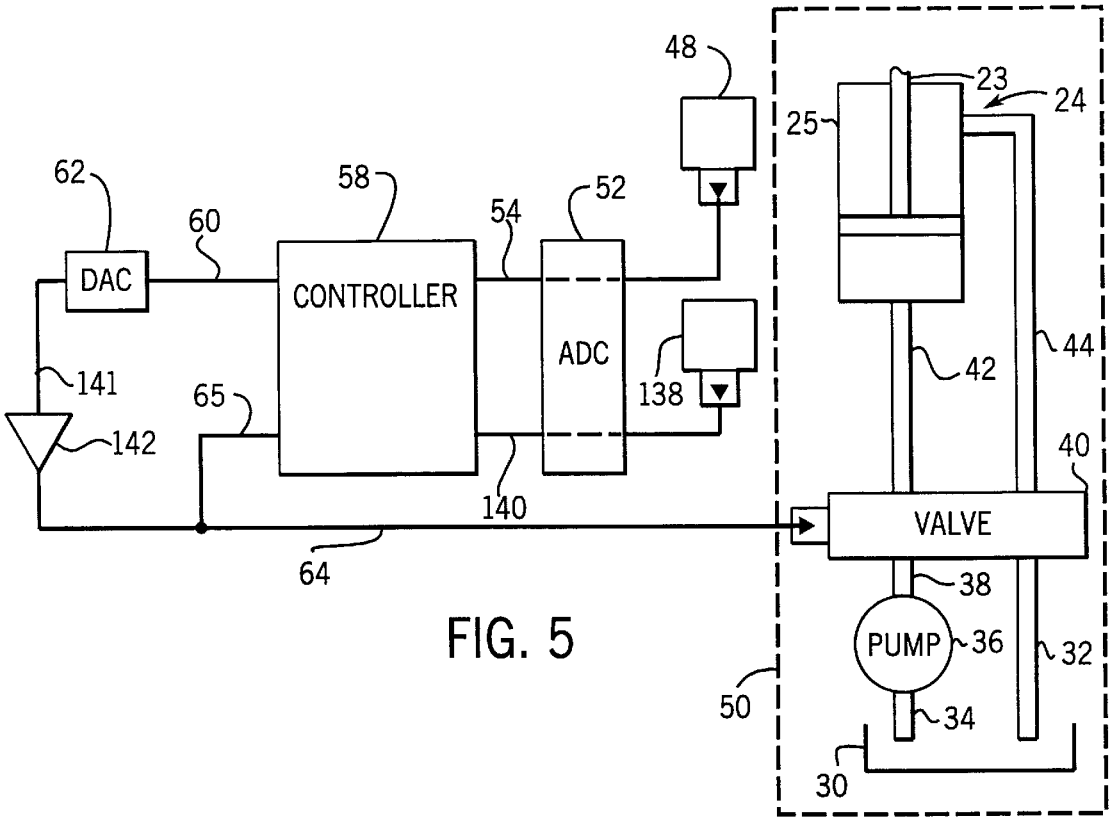
FIG. 5 is a diagrammatic view of a control system used with the wheel loader illustrated in FIG. 1 and including an accelerometer in a second embodiment of the present invention.

The sensor used to generate the acceleration signal is not limited to the pressure transducer 46 but an accelerometer or other sensor for directly sensing acceleration may be used. In an alternate embodiment, as illustrated in FIG. 5, the pressure signal generated by transducer 46 can be replaced or supplemented with an acceleration signal generated by an accelerometer 138. Referring to FIG. 5, the hydraulic system 50 includes a hydraulic fluid source 30; a hydraulic return line 32; a hydraulic supply conduit 34; a hydraulic pump 36; hydraulic lines 38, 42, and 44; and an electronic valve 40.

The control system also includes an accelerometer 138; a position sensor 48; an analog-to-digital converter (ADC) 52; a position signal data bus 54; an acceleration signal data bus 140; an electronic controller 58; a control signal data bus 60; a digital to analog converter 62; conductor 141; amplifier 142; and an analog control signal conductor 64. Preferably, accelerometer 138 is configured to generate a signal representative of acceleration in a vertical direction, i.e., in a direction substantially perpendicular to the surface upon which the work vehicle rests. In this embodiment, the control system is configured to maintain acceleration substantially constant at zero.

Accelerometer 138 and position sensor 48 are connected to ADC 52. Electronic controller 58 is connected to ADC 52 via position signal data bus 54 and acceleration signal data bus 140, is connected to DAC 62 via control signal data bus 60. DAC 62 is connected to electronic valve 40 via conductor 141, amplifier 142, and analog control signal conductor 64.

Electronic controller 58 operates to keep the pressure in hydraulic actuators 24 relatively constant thereby dampening vertical motions of the vehicle. In operation, accelerometer 138, which may be located in the vehicle cab, measures the vertical acceleration of the vehicle. A signal from accelerometer 138 is communicated to ADC 52 where the analog acceleration signal is converted to a digital acceleration signal. Position sensor 48 measures the angular position of the lift arms 22. The analog position sensor signal is also sent to the ADC 52 where it is converted to a digital position signal. The sampled position signal and the sampled acceleration signal are communicated to electronic controller 58 over data buses 54 and 140 respectively. Using the sampled sensor information, electronic controller 58 calculates a digital control signal. The digital control signal is passed over data bus 60 to DAC 62 where the digital signal is converted to an analog control signal that is amplified by amplifier 142. The amplified control signal is transmitted over conductor 64 to electronic valve 40.

Electronic valve 40 controls the flow of hydraulic fluid into and out of hydraulic actuator 24 thereby causing actuator column 23 to move in or out of actuator cylinder 25. The analog control signal received from bus 64 commands electronic valve 40 to control both the direction of hydraulic fluid flow and the volumetric flow of the fluid. By way of example, both the fluid direction signal and the flow volume signal can be generated by DAC 62. Excess hydraulic fluid is directed by electronic valve 40 through return line 32 and back to hydraulic fluid source 30.

Figure 6:
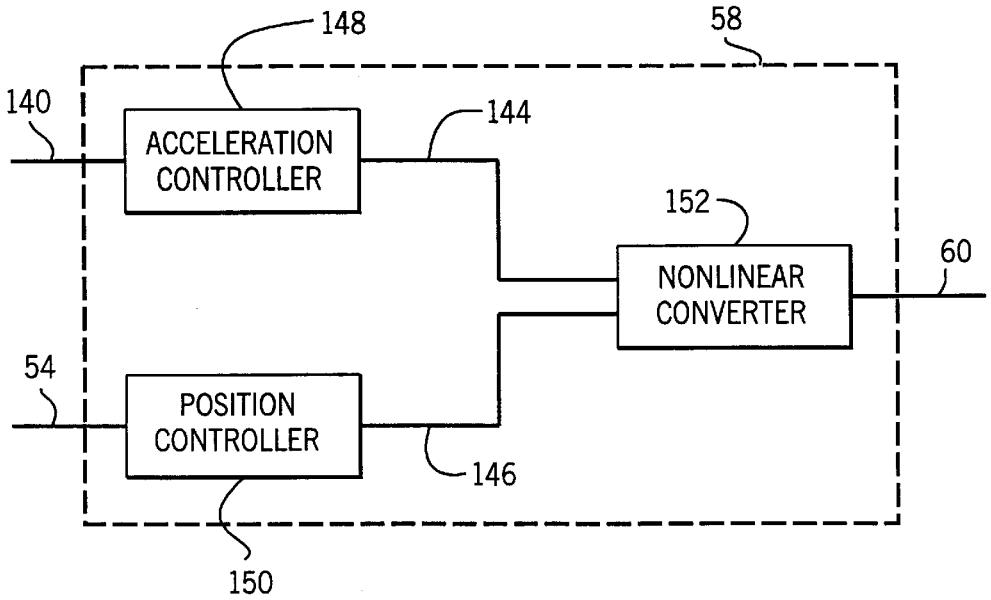
FIG. 6 is a schematic block diagram of a second embodiment of the ride control system forming part of the present invention.

A second embodiment of the electronic controller is illustrated in FIG. 6. Referring to FIG. 6, electronic controller 58 includes signal buses 144 and 146; an acceleration controller 148; a position controller 150; and a nonlinear converter 152.

The input side of electronic controller 58 is connected to data buses 54 and 140. The acceleration controller 148 is connected via acceleration control signal bus 144 to the nonlinear converter 152. The position controller 150 is connected via position control signal bus 146 to the nonlinear converter 152. The output of the nonlinear converter is connected to data bus 60.

Figure 7:
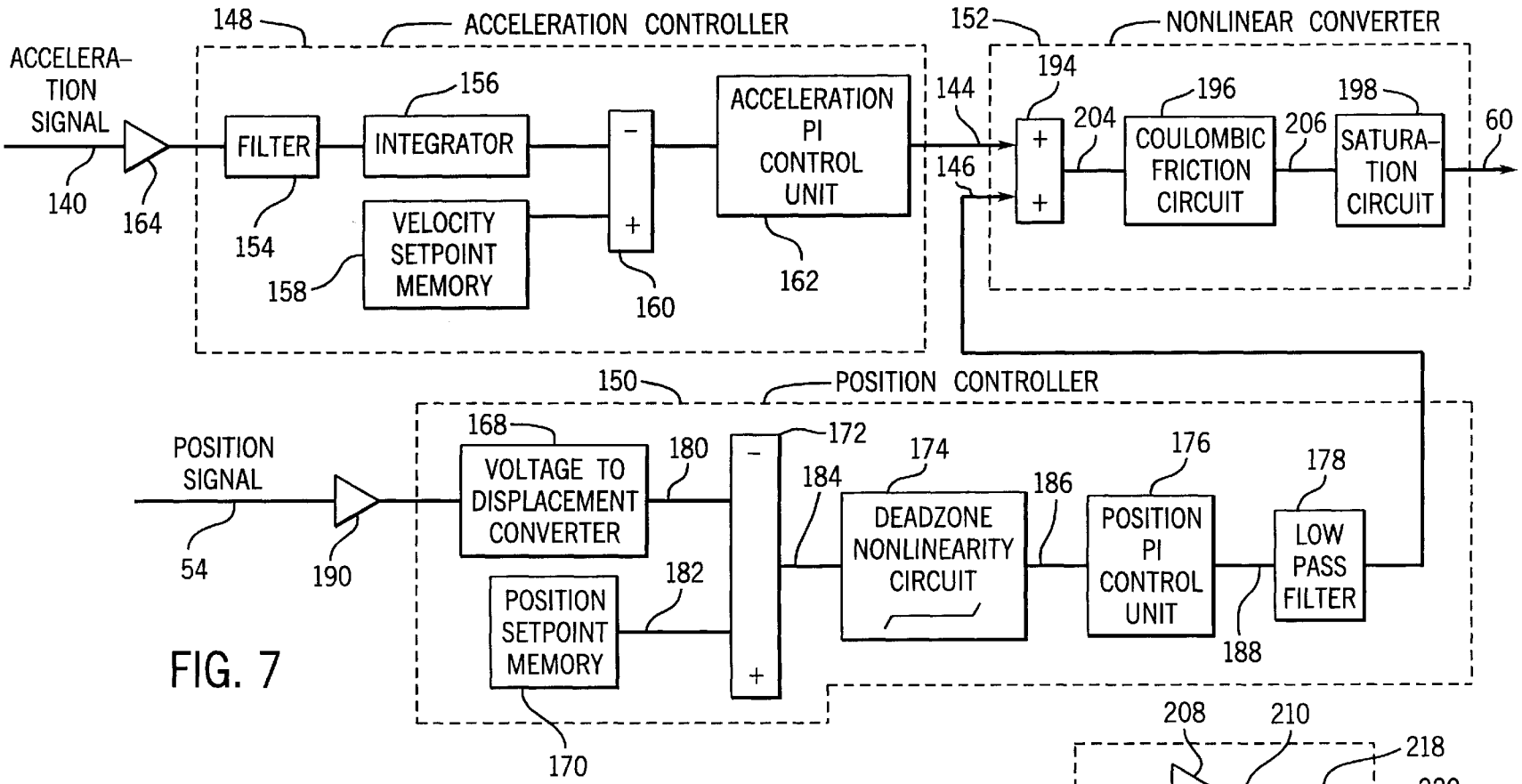
FIG. 7 is a schematic block diagram of a second embodiment of the electronic controller forming part of the present invention.

Referring to FIG. 7, acceleration controller 148 calculates the acceleration control signal used by electronic controller 58 to maintain the hydraulic fluid pressure in actuator 24 relatively constant. More specifically, acceleration controller 148 includes a filter 154, an integrator 156; a velocity setpoint memory 158; a differencing junction 160; and an acceleration PI (proportional-integral) control unit 162. The output of the acceleration controller 148 is a signal passed over the acceleration control signal bus 144 to the nonlinear converter 152.

To calculate the proper acceleration control signal, information from the accelerometer 138 is communicated to the acceleration controller 148 over data bus 140. The signal on bus 140 is amplified by amplifier 164 to generate a signal applied to the filter 154. The filter 154 is a median filter designed to remove spike noise from the acceleration signal. The output of the filter 154 is fed to an integrator 156, which generates a velocity signal representative of vertical velocity. The velocity signal is compared with a velocity setpoint selected from memory 158 at the differencing junction 160 to generate an error signal on bus 166. Preferably, the velocity setpoint, representative of desired vertical velocity, is set to zero. The error signal is communicated to the acceleration control PI unit 162. The acceleration control PI unit 162 computes an acceleration control signal by applying a proportional integral control algorithm to the error signal. The acceleration control signal is communicated over the acceleration control signal bus 144 to the nonlinear converter 152.

Figure 8:
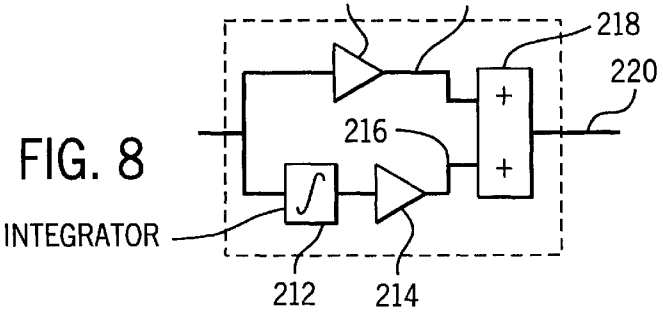
FIG. 8 is a block diagram of a proportional integral (PI) control unit.

A PI unit is shown in more detail in FIG. 8. Essentially, an input signal is directed along two paths. In one path, the input signal is amplified by a gain circuit 208 to produce a signal on bus 210. In the other path, the input signal is integrated with respect to time by circuit 212, and amplified by a gain circuit 214 to produce a signal on bus 216. A summing junction 218 adds the signals on buses 210 and 216 to produce the output control signal on bus 220.

The position controller 150 also calculates a position control signal used by the nonlinear converter 152. The position controller 150 essentially acts to eliminate any slow upward or downward movement of the implement over time. The position controller 150 is placed in parallel to the acceleration controller 148. The position controller 150 includes a voltage to displacement converter 168; a position setpoint memory 170; a differencing junction 172; a deadzone nonlinearity circuit 174; a position PI (proportional integral) control unit 176; a low pass filter 178; and signal buses 180, 182, 184, 186, 188. The output of the position controller 150 is a signal passed over the position control signal bus 146 to the nonlinear converter 152.

More specifically, information from the position sensor 48 is communicated to the position controller 150 over data bus 54. The signal on bus 54 is amplified by an amplifier 190 to generate a signal applied to the converter 168. The converter 168 scales the signal to correspond to the displacement of lift arms 22. The scaled signal is compared with position setpoint selected with memory 170 at differencing junction 172 to generate an error signal on bus 184. The error signal is communicated to deadzone nonlinearity circuit 174 which provides a zero output when the position of the lift arms 22 are within a predetermined range of the setpoint (e.g. two degrees). Thus, deadzone nonlinearity circuit 174 ensures that the position control does not interfere with small motions created by the acceleration control. The signal output of deadzone nonlinearity circuit 174 is sent to position PI control unit 176. The position PI control unit 176 computes a control signal by applying a proportional integral control algorithm to its input signal as illustrated in FIG. 8. The output signal from the control unit is sent to the low pass filter 178. The output signal of the filter 178 is sent via signal bus 146 to the nonlinear converter 152.

As mentioned, the acceleration control signal bus 144 is connected to the input side of nonlinear converter 152, as is the position control signal bus 146. Nonlinear converter 152 includes a summing junction 194; a coulombic friction circuit 196; a saturation circuit 198; and signal buses 204 and 206. The output bus 204 of summing junction 194 is connected to the coulombic friction circuit 196. The output of the coulombic friction circuit 196 is connected to the saturation circuit 198 via bus 206. The output of the saturation circuit 198 is a signal on control signal data bus 60.

The purpose of the nonlinear converter 152 is to transform the valve control signal on bus 204 to a signal which takes into account nonlinear effects of valve 40 including frictional losses and saturation in which the valve has some maximum hydraulic fluid flow rate. The acceleration control signal and the position control signal are added together at summing junction 194. Summing junction 194 communicates a signal to the coulombic friction circuit 196. Coulombic friction circuit 196 compensates for the deadband of electronic valve 40, and modifies the signal based upon the deadband. Circuit 196 adds a positive offset to positive signals and adds a negative offset to negative signals. Coulombic friction circuit 196 communicates a signal over connection 206 to saturation circuit 198. Saturation circuit 198 models the maximum and minimum flow limitations of electronic valve 40 and clips the signal if it corresponds to flow values outside of the maximum or minimum flow values of the valve. Saturation circuit 198 communicates a signal over data bus 60. In the preferred embodiment, controllers 148 and 150, and nonlinear converter 152 are implemented with a programmed digital processor. Thus, prior to amplification by amplifier 142, the flow control signal would be applied to DAC 62, as is illustrated in FIG. 5.

The control system as described in FIGS. 6 and 7 does not require both the acceleration controller 148 and position controller 150, but is operable using the acceleration controller by itself.

The type of work vehicles and excavators to which the described ride control can be applied includes, but is not limited to, backhoes, snowplows, cranes, skid-steer loaders, tractors including implements such as plows for earth working, wheel loaders (see FIG. 1), and other construction or utility vehicles having an implement, arm, or boom moveable relative to the vehicle frame. The ride control system is not limited to vehicles with a pair of lift arms 22 such as the wheel loader 10, but may also be applied to vehicles with a multiplicity of lift arms or a single lift arm such as on a backhoe or a crane.

The actuation devices, used to move the implements, are used to dampen bouncing and pitching of the vehicle by appropriately moving the implement relative to the vehicle frame. The ride control system may be applied to vehicles using various types of hydraulic actuation systems including hydraulic actuators 24 and hydraulic motors.

The electronic controller 58 shown in FIGS. 2 and 5 are programmed microprocessors but can also be other electronic circuitry, including analog circuitry, that provides the proper control signal to the electronic valve 40 to keep the pressure in the hydraulic actuator 24 substantially constant. The programming of the microprocessors is not limited to the methods described above. An appropriate control scheme can be used such that the goal is to keep the hydraulic cylinder pressure constant. Such control techniques include but are not limited to classical control, optimal control, fuzzy logic control, state feedback control, trained neural network control, adaptive control, robust control, stochastic control, proportional-derivative (PD) control, and proportional-integral-derivative control (PID).

From the foregoing, it will be observed that numerous modifications and variations can be effected without departing from the true spirit and scope of the novel concept of the present control system. It will be appreciated that the present disclosure is intended as an exemplification of the control system, and is not intended to limit the control system to the specific embodiment illustrated. The disclosure is intended to cover by the appended claims all such modifications as fall within the scope of the claims.

What is claimed is:

1. A control system for reducing the oscillation of a work vehicle as it moves across a surface, the work vehicle of the type including an implement moveable relative to a vehicle, the system comprising:

a hydraulic fluid source;

a hydraulic actuator coupleable between the vehicle and the implement to lift the implement;

an electronic valve coupled to the source and the actuator to control the flow of hydraulic fluid applied to the actuator by the source;

an accelerometer coupleable to the work vehicle to generate an acceleration signal related to an acceleration of the work vehicle;

a position transducer mechanically coupleable between the implement and the vehicle to generate a position signal representative of a position of the implement with respect to the vehicle; and an electronic controller coupled to the electronic valve, the accelerometer, and the position transducer, the controller generating valve command signals for the work vehicle based upon the acceleration signal and the position signal and applying the command signals to the electronic valve to cause the electronic valve to control the flow of the hydraulic fluid applied to the actuator to reduce the oscillation of the work vehicle as it moves across the surface.

2. The control system of claim 1, wherein the hydraulic actuator is a hydraulic cylinder coupleable between the implement and the vehicle.

3. The control system of claim 1, wherein the hydraulic actuator is a hydraulic motor coupleable between the implement and the vehicle.

4. The control system of claim 1, wherein the electronic controller includes a microprocessor, an analog-to-digital converter coupled to the accelerometer, the position transducer and the microprocessor, and a digital-to-analog converter coupled to the electronic valve and the microprocessor.

5. The control system of claim 1, wherein the acceleration signal is representative of vertical acceleration.

6. An excavator comprising:

a wheeled vehicle;

an implement movably supported by the vehicle;

a hydraulic fluid source supported by the vehicle;

a hydraulic actuator coupled between the implement and the vehicle to move the implement relative to the vehicle;

an electronic valve coupled to the source and the actuator to control the flow of hydraulic fluid applied to the actuator by the source;

means for generating an acceleration signal related to an acceleration of the vehicle;

means mechanically coupled between the implement and the vehicle for generating a position signal representative of a position of the implement with respect to the vehicle; and an electronic controller coupled to the electronic valve, the means for generating an acceleration signal, and the means for generating a position signal, the controller generating valve command signals for the vehicle based upon the acceleration signal and the position signal, and applying the command signals to the electronic valve to cause the electronic valve to control the flow of hydraulic fluid applied to the actuator to reduce the oscillation of the vehicle as it moves across a surface.

7. The excavator of claim 6 wherein the means for generating an acceleration signal is an accelerometer.

8. The excavator of claim 1, wherein the hydraulic actuator is a hydraulic cylinder coupled between the implement and the vehicle.

9. The excavator of claim 6, wherein the electronic controller includes a microprocessor, an analog-to-digital converter coupled to the means for generating an acceleration signal, the means for generating a position signal, and the microprocessor, and a digital-to-analog converter coupled to the electronic valve and the microprocessor.

10. An excavator comprising:

a wheeled vehicle;

an implement movably supported by the vehicle;

a hydraulic fluid source supported by the vehicle;

a hydraulic actuator coupled between the implement and the vehicle to move the implement relative to the vehicle;

an electronic valve coupled to the source and the actuator to control the flow of the hydraulic fluid applied to the actuator by the source;

an accelerometer supported relative to the vehicle and implement to generate an acceleration signal representative of a vertical acceleration of the excavator;

a position transducer mechanically coupled between the implement and the vehicle to generate a position signal representative of a position of the implement with respect to the vehicle; and an electronic controller coupled to the electronic valve, the accelerometer, and the position transducer to determine a vertical velocity signal of the excavator based upon the acceleration signal, to utilize the velocity signal to generate valve control signals, and to apply the valve control signals to the electronic valve to cause the electronic valve to control the flow of hydraulic fluid applied to the actuator to reduce the oscillation of the vehicle as it moves across a surface.

11. The excavator of claim 10, wherein the hydraulic actuator is a hydraulic cylinder coupled between the implement and the vehicle.

12. The excavator of claim 10, wherein the electronic controller includes a microprocessor, an analog-to-digital converter coupled to the accelerometer, the position transducer, and the microprocessor, and a digital-to-analog converter coupled to the electronic valve and the microprocessor.

13. The excavator of claim 10, wherein the electronic controller integrates the acceleration signal to generate a velocity signal and further compares the velocity signal to a predetermined desired velocity value to produce a velocity difference signal, the valve command signals generated based on the velocity difference signal.

14. The excavator of claim 13, wherein the electronic controller performs a proportional internal control algorithm on the velocity difference signal to generate a control signal, the valve command signals generated based on the control signal.

15. The excavator of claim 13, wherein the electronic controller further adds the acceleration control signal with a predetermined pressure signal bias, to generate a control signal, the valve command signals generated based on the control signal.

16. The control system of claim 1, wherein the accelerometer is coupled to the implement to generate an acceleration signal related to a vertical acceleration of the implement.

17. The excavator of claim 6, wherein the means for generating an acceleration signal is coupled to the implement to generate an acceleration signal related to a vertical acceleration of the implement.

18. The excavator of claim 10, wherein the accelerometer is coupled to the implement to generate an acceleration signal related to a vertical acceleration of the implement.

19. The control system of claim 1, wherein the position transducer senses position over the full range of motion of the implement with respect to the vehicle.

20. The excavator of claim 6, wherein the means for generating a position signal senses position over the full range of motion of the implement with respect to the vehicle.

21. The excavator of claim 10, wherein the position transducer senses position over the full range of motion of the implement with respect to the vehicle.

* * * * *